US009835160B2

(12) United States Patent
Torrey et al.

(10) Patent No.: US 9,835,160 B2
(45) Date of Patent: Dec. 5, 2017

(54) SYSTEMS AND METHODS FOR ENERGY OPTIMIZATION FOR CONVERTERLESS MOTOR-DRIVEN PUMPS

(71) Applicant: General Electric Company, Schenectady, NY (US)

(72) Inventors: David Allan Torrey, Ballston Spa, NY (US); Nathaniel Benedict Hawes, Milton, NY (US); Deepak Aravind, Karnataka (IN)

(73) Assignee: General Electric Company, Niskayuna, NY (US)

( * ) Notice: Subject to any disclaimer, the term of this patent is extended or adjusted under 35 U.S.C. 154(b) by 410 days.

(21) Appl. No.: 14/563,119

(22) Filed: Dec. 8, 2014

(65) Prior Publication Data

US 2016/0160862 A1 Jun. 9, 2016

(51) Int. Cl.
*F04B 47/06* (2006.01)
*F04D 15/00* (2006.01)
(Continued)

(52) U.S. Cl.
CPC ..... *F04D 15/0066* (2013.01); *E21B 43/128* (2013.01); *F04B 35/04* (2013.01);
(Continued)

(58) Field of Classification Search
CPC ..... F04D 15/0066; F04D 13/06; F04D 7/02; F04B 49/065; F04B 35/04; F04B 47/06; E21B 43/128
See application file for complete search history.

(56) References Cited

U.S. PATENT DOCUMENTS 7,170,262 B2 * 1/2007 Pettigrew ..... H02P 9/42 290/40 C
8,275,488 B2 9/2012 Kim et al.
(Continued)

FOREIGN PATENT DOCUMENTS

CN 102222938 A 10/2011
CN 103386935 A 11/2013
(Continued)

OTHER PUBLICATIONS

PCT Search Report and Written Opinion issued in connection with corresponding PCT Application No. PCT/US2015/063362 dated Apr. 1, 2016.
(Continued)

*Primary Examiner* — Peter J Bertheaud
*Assistant Examiner* — Dnyanesh Kasture
(74) *Attorney, Agent, or Firm* — Pabitra K. Chakrabarti

(57) ABSTRACT

A converterless motor-driven pump system includes an off-grid prime mover, an electric power generator driven by the off-grid prime mover to generate a power output, an electric submersible pump (ESP) system, and a system controller. The ESP system includes a motor coupled to the electric power generator to receive the power output, and a pump driven by the motor to pump a fluid. The system controller includes a processor and a memory. The memory includes instructions that, when executed by the processor, cause the system controller to control the off-grid prime mover as a function of an operational parameter of the ESP system to maintain a desired operating point of the pump, and control the electric power generator to reduce the power output generated by the electric power generator while the desired operating point of the pump is maintained.

11 Claims, 4 Drawing Sheets

(51) Int. Cl.

| | |
|---|---|
| ***F04D 13/06*** | (2006.01) |
| ***F04D 7/02*** | (2006.01) |
| ***E21B 43/12*** | (2006.01) |
| ***F04B 35/04*** | (2006.01) |
| ***F04B 49/06*** | (2006.01) |

(52) U.S. Cl.
CPC ..... *F04B 47/06* (2013.01); *F04B 49/065* (2013.01); *F04D 7/02* (2013.01); *F04D 13/06* (2013.01)

(56) References Cited

U.S. PATENT DOCUMENTS

| | | | | |
|---|---|---|---|---|
| 8,742,605 | B1 | 6/2014 | Wilhide et al. | |
| 2009/0234509 | A1* | 9/2009 | Becker | F02D 29/06 700/287 |
| 2010/0231146 | A1 | 9/2010 | Beck et al. | |
| 2011/0033314 | A1 | 2/2011 | Plitt et al. | |
| 2014/0049229 | A1 | 2/2014 | Li et al. | |
| 2015/0078917 | A1* | 3/2015 | Torrey | F04D 15/0066 417/42 |

FOREIGN PATENT DOCUMENTS

| | | | |
|---|---|---|---|
| CN | 103746639 | A | 4/2014 |
| WO | 2005062458 | A1 | 7/2005 |

OTHER PUBLICATIONS

Elgendy et al., "Assessment of Perturb and Observe MPPT Algorithm Implementation Techniques for PV Pumping Applications," IEEE Transactions on Sustainable Energy, vol. 3, Issue 1, pp. 21-33.

Arifin et al., "Simulation of Switched Reluctance Generator in Low and Medium Speed Operations for Wind Energy Application," ISRN Renewable Energy, 2012, pp. 1-13.

Nedumgatt et al., "Perturb and observe MPPT algorithm for solar PV systems-modeling and simulation," India Conference (INDICON), 2011 Annual IEEE, pp. 1-6.

Sugiarto, et al., "On the improvement of energy efficiency in existing fixed speed WECS," 2011 International Conference on Electrical Machines and Systems (ICEMS), Aug. 2011, pp. 1-7.

* cited by examiner

SYSTEMS AND METHODS FOR ENERGY OPTIMIZATION FOR CONVERTERLESS MOTOR-DRIVEN PUMPS

BACKGROUND

This description relates to converterless motor-driven pumps, and more particularly, to systems and methods for energy optimization for converterless motor driven pumps.

Electric submersible pumps (ESPs) are sometimes used in the oil and gas industry for pumping operations in off-grid applications. Typically, one or more prime movers are directly coupled to generators to produce an AC voltage having a fixed frequency and amplitude to supply electrical loads. The generated AC power is fed to a variable speed drive (VSD). The VSD uses a power converter to adjust the frequency and amplitude of the AC power to control operation of the ESPs. The output of the VSD is provided to the motors of the ESPs via a suitable transformer.

Most known systems for operating ESPs are large, complex, expensive systems. Such known systems use a large amount of energy. To the extent possible, this energy consumption should be minimized, thereby reducing the operating temperatures of the components of the systems, thereby potentially increasing the service life of one or more of the components of the systems.

BRIEF DESCRIPTION

In one aspect, a converterless motor-driven pump system includes an off-grid prime mover, an electric power generator driven by the off-grid prime mover to generate a power output, an electric submersible pump (ESP) system, and a system controller. The ESP system includes a motor coupled to the electric power generator to receive the power output, and a pump driven by the motor to pump a fluid. The system controller includes a processor and a memory. The memory includes instructions that, when executed by the processor, cause the system controller to control the off-grid prime mover as a function of an operational parameter of the ESP system to maintain a desired operating point of the pump, and control the electric power generator to reduce the power output generated by the electric power generator while the desired operating point of the pump is maintained.

In another aspect, a method of operating an electric submersible pump (ESP) system including an off-grid prime mover driving an electric power generator to produce a power output for a motor driving a submersible pump is provided. The method includes controlling a rotational speed of the off-grid prime mover as a function of an operational parameter of the ESP system to maintain a desired operating point of the submersible pump, and controlling a voltage output of the electric power generator to reduce the power output generated by the electric power generator while maintaining the desired operating point of the submersible pump.

In a further aspect, a system controller for a converterless motor-driven pump system includes a prime mover, an electric power generator driven by the prime mover to generate a power output, and an electric submersible pump (ESP) system including a motor powered by the power output and a pump driven by the motor. The system controller includes a processor and a memory. The memory includes instructions that, when executed by the processor, cause the system controller to control a rotational speed of the prime mover as a function of an operational parameter of the ESP system to maintain a desired operating point of the pump, and control the electric power generator to reduce the power output generated by the electric power generator while the desired operating point of the pump is maintained.

DRAWINGS

These and other features, aspects, and advantages of the present disclosure will become better understood when the following detailed description is read with reference to the accompanying drawings in which like characters represent like parts throughout the drawings, wherein.

Figure 1:
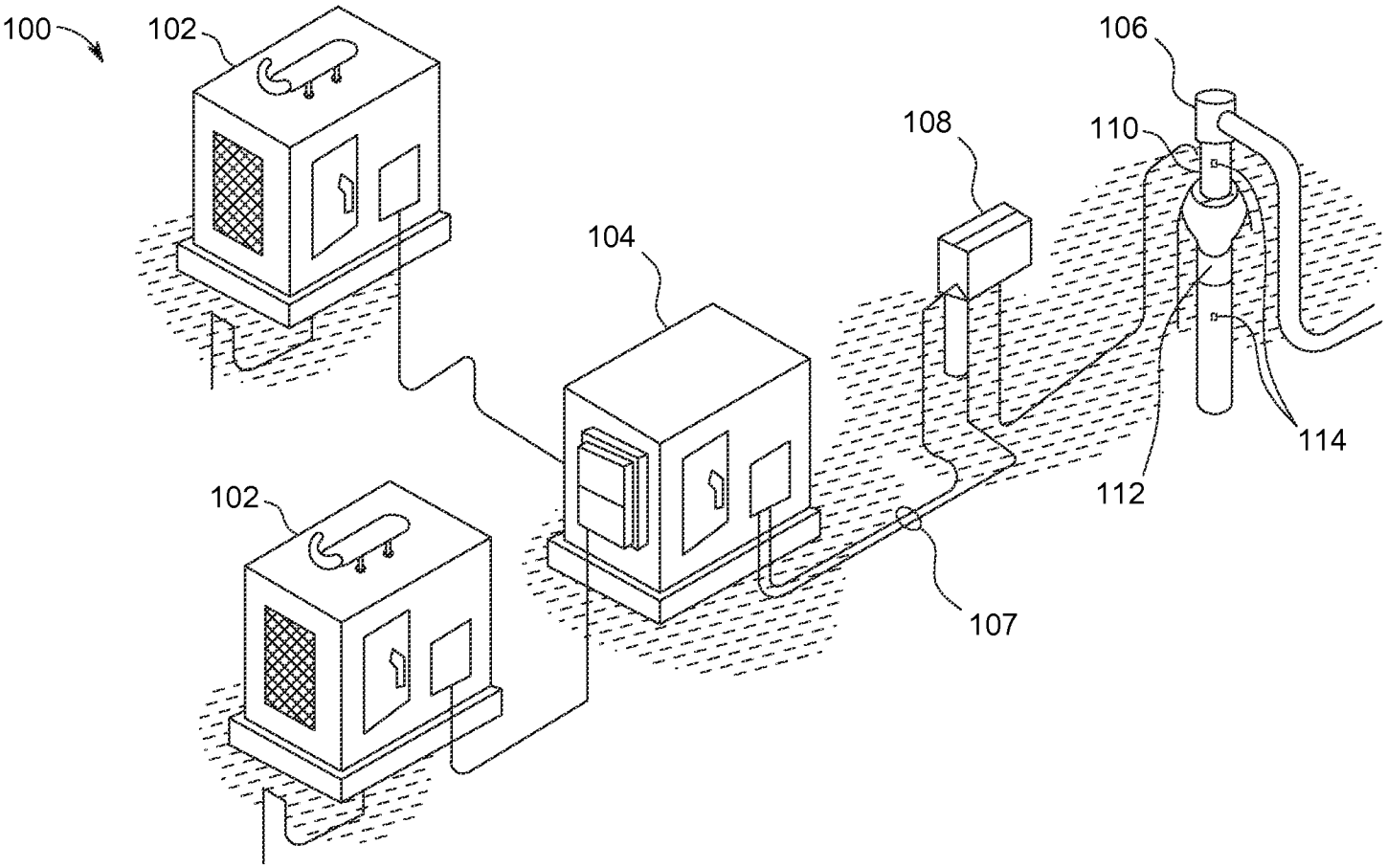
FIG. 1 is an exemplary converterless electric submersible pump (ESP) system.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Embodiments of the present disclosure relate to converterless systems for operating an electric submersible pump (ESP). The converterless ESP systems described herein eliminate the variable speed drive and, potentially, its associated transformer from typical motor driven submersible pump systems, resulting in a simpler system that reduces capital expense, weight and system footprint. Further, the exemplary ESP systems reduce the energy used by the system when operating, thereby increasing the efficiency of the system, reducing temperatures of components of the system, and decreasing the cost of operating the system.

FIG. 1 is an exemplary converterless electric submersible pump (ESP) system 100. ESP system 100 includes power generation systems 102, an electronics house (E-house) 104, and an ESP 106. Generally, power generation systems 102 produce electric power that is provided to E-house 104. E-house 104 is connected to ESP 106 using an ESP cable 107 coupled to a junction box 108. E-house 104 uses the electric power to operate ESP 106 to pump a fluid, typically from a well.

Each power generation system 102 includes a prime mover and a generator (neither shown in FIG. 1). The prime movers are turbines, reciprocating engines fueled by natural gas or diesel fuel, or any other prime mover suitable for use as described herein. Each prime mover drives its associated generator to produce an alternating current (AC) output current. In some embodiments, each power generation system 102 produces a direct current (DC) output current to power a DC powered ESP 106. In the exemplary embodiment, each prime mover is an off-grid prime mover that is not powered by an electric utility power grid. In the exemplary embodiment, the generators are synchronous generators. In other embodiments, the generators may be any other suitable type of generator. In some embodiments, each power generation system 102 is capable of producing about 250 kilowatt (kW) of output power, and the system may operate with a single power generation system 102. In other embodiments, each power generation system 102 is capable of providing up to about a six MW output, as required by the pumping effort required from the ESP. In other embodiments, power generation systems 102 are configured to output an amount of power sufficient to power ESP 106. Although two power generation systems 102 are shown in FIG. 1, system 100 may include more or fewer power generation systems. In some embodiments, a gearbox (not shown) may be coupled between the prime mover and the generator to match the shaft speeds of the prime mover and generator to facilitate the most productive use of the equipment. The gearbox may be a fixed ratio gearbox or any other suitable gearbox.

E-house 104 generally houses electronics components for controlling system 100. In the exemplary embodiment, E-house includes a system controller, contactors, and sensors (none shown in FIG. 1). The system controller controls overall operation of system 100. The contactors facilitate providing and/or interrupting electric current flow from power generation system(s) 102 to ESP 106. The sensors in E-house 104 are configured to detect characteristics of the electric power received from power generation systems 102 and/or provided to ESP 106. In the exemplary embodiment, the sensors detect the electrical voltage, frequency, and current provided to ESP 106. In other embodiments, the sensors detect any characteristics of the electric power that enable operation of ESP system 100 as described herein.

ESP 106 includes a motor 110, a pump 112, and sensors 114. Power delivered to ESP 106 by E-house 104 is used to power motor 110. Operation of motor 110 drives pump 112, which may then pump a fluid. ESP 106 is typically located within a well for purposes of artificially lifting a fluid from the well. The fluid may be, without limitation, water, gas, oil, or a combination thereof. Some amount of solids, such as sand or proppant, will be entrained with the fluid. In the exemplary embodiment, motor 110 is an induction motor. In other embodiments, motor 110 may be any type of motor suitable for driving a pump. Sensors 114 detect characteristics associated with the ESP. In the exemplary embodiment, sensors 114 detect the inlet and outlet pressures of pump 112, the temperature of the fluid being pumped, and the temperature of motor 110. Other embodiments include any sensors configured to detect characteristics that enable operation of ESP system 100 as described herein, including, without limitation, vibration, fluid leakage, motor speed, and pump speed.

Generally, the system controller controls operation of system 100, at least in part, through control of power generation systems 102. More specifically, the system controller controls the speed of the prime movers to set the frequency of the output of power generation systems 102. The frequency of the output sets the speed of motor 110. The speed of motor 110 determines (in combination with other factors such as the viscosity of the fluid and the presence or absence of obstructions) the pressure at the inlet of pump 112. Accordingly, the system controller controls the speed of the prime movers to regulate an operational parameter of ESP 106 to an operating setpoint (also referred to as a desired operating state). In the exemplary embodiment, the operational parameter is the inlet pressure of pump 112. In other embodiments, the operational parameter is the speed of the motor 110 or any other variable of motor 110 or pump 112 that permits operation as described herein. The system controller controls the excitation current provided to the generators of power generation systems 102 to control the voltage of the power generation systems' output. In other embodiments, the system controller controls the voltage of the power generation system using any other suitable control method. The magnitude of the output voltage determines the amount of current delivered to motor 110, and thereby affects the amount of power delivered to motor 110. The system controller monitors the voltage current and frequency of the output and controls the excitation current to reduce the power used by ESP 106 while remaining at the operating setpoint.

Figure 2:
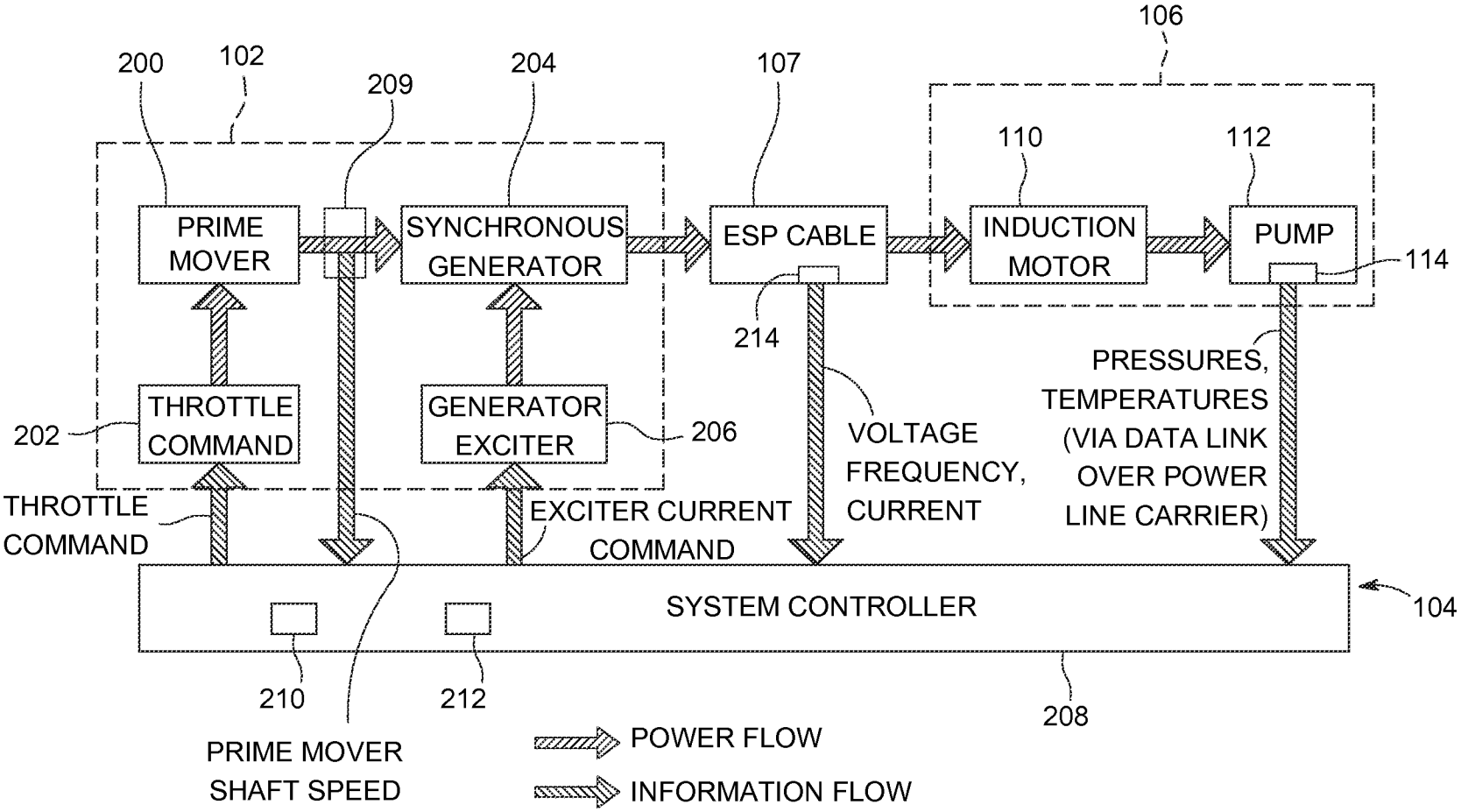
FIG. 2 is a block diagram of an exemplary embodiment of the system shown in FIG. 1 including the flow of power and information through the system.

FIG. 2 is a block diagram of an exemplary embodiment of system 100 showing the flow of power and information through system 100. To maintain simplicity of illustration, a single power generation system 102 is shown in FIG. 2. It should be understood, however, that system 100 may include any suitable number of power generation systems 102. In the exemplary embodiment, power generation system 102 includes a prime mover 200, a throttle control 202 of prime mover 200, a synchronous generator 204 driven by prime mover 200, and a generator exciter 206 to provide excitation current to synchronous generator 204. Generator exciter 206 may be a component of generator 204 (e.g., integrated within generator 204) or may be component separate from generator 204. ESP cable 107 connects power generation system 102 to ESP 106, and more particularly, to induction motor 110 driving pump 112. Power flows from prime mover 200 through generator 204 and ESP cable 107 to motor 110 and subsequently the pump 112. The power between prime mover 200 and generator 204 is mechanical driveshaft power, as is the power between the induction motor 110 and pump 112. In some embodiments, a gearbox between prime mover 200 and generator 204 is employed for purposes of system optimization. Pump motor 110 may be any electric motor that can be line started, including, without limitation, an induction motor or a permanent magnet motor.

A system controller 208 is responsible for monitoring pump operating conditions, including without limitation input and output pressures, pump temperature(s), pump vibration levels, and pump rotational speed, and commanding throttle control 202 of prime mover 200 to a position that will drive pump 112 output to the desired pump operating point in response to one or more of the monitored operating conditions. System controller 208 also monitors, via a sensor 209, the shaft speed of prime mover 200 and commands generator exciter 206 of the synchronous generator 204.

In the exemplary embodiment, controller 208 is implemented in a computing device. Controller 208 includes a processor 210 and a memory 212. Generally, memory 212 stores non-transitory instructions that, when executed by processor 210, cause controller 208 to operate as described herein. It should be understood that the term "processor" refers generally to any programmable system including systems and microcontrollers, reduced instruction set circuits (RISC), application specific integrated circuits (ASIC), programmable logic circuits, programmable logic controller, and any other circuit or processor capable of executing the functions described herein. The above examples are exemplary only, and thus are not intended to limit in any way the definition and/or meaning of the term "processor." Memory 212 may include, but is not limited to only include, non-volatile RAM (NVRAM), magnetic RAM (MRAM), ferroelectric RAM (FeRAM), read only memory (ROM), flash memory and/or Electrically Erasable Programmable Read Only Memory (EEPROM). Any other suitable magnetic, optical and/or semiconductor memory, by itself or in combination with other forms of memory, may be included in memory 212. Memory 212 may also be, or include, a detachable or removable memory, including, but not limited to, a suitable cartridge, disk, CD ROM, DVD or USB memory. In other embodiments, controller 208 is implemented in analog circuitry, digital circuitry, or a combination of analog circuitry, digital circuitry, and/or computing devices.

System controller 208 monitors, using a suite of sensors 214, the voltage, frequency and current being supplied to the motor 110. As described above, system controller 208 also monitors characteristics (such as inlet pressure, outlet pressure, temperatures, etc.) of ESP 106 via sensors 114. System controller 208 controls operation of system 100 based, at least in part, on the data received from sensors 214 and 114.

Figure 3:
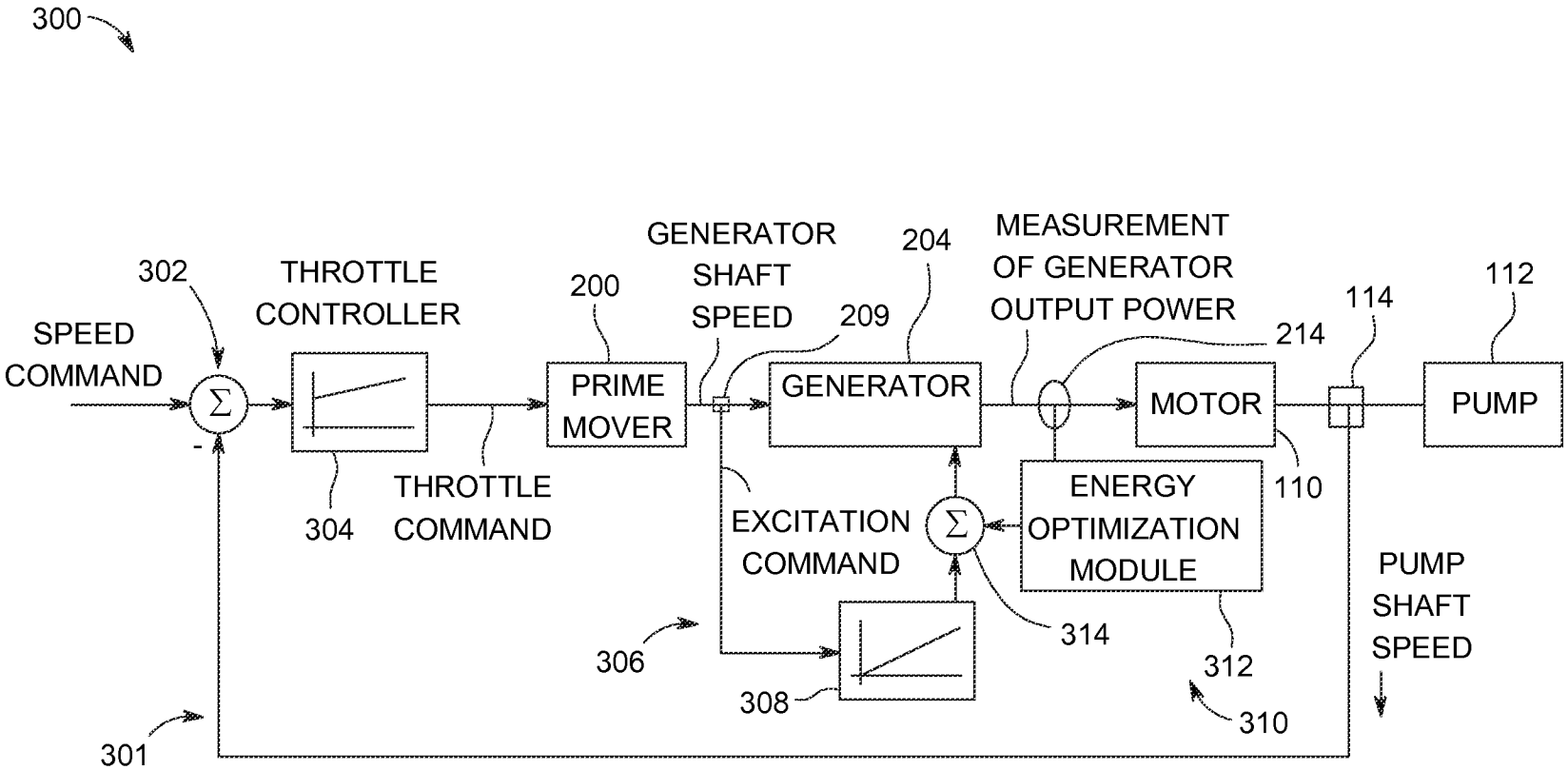
FIG. 3 is a block diagram of a portion of a control scheme for the ESP system shown in FIG. 1.

FIG. 3 is a block diagram of a portion of a control scheme 300 for a converterless ESP system, such as ESP system 100. Control scheme 300 is performed by system controller 208. In other embodiments different and/or additional controllers may perform one or more portions of control scheme 300.

An outer control loop 301 in control scheme 300 controls operation of system 100 to a desired operating point (e.g., a desired rate of pumping). In the exemplary embodiment, the desired operating point is associated with a shaft speed of induction motor 110, which will drive pump 112 at a desired speed to achieve the desired rate of pumping. At 302, a nominal speed command is summed, by system controller 208, with a detected speed (negated) of motor 110 (from one of sensors 114). The resulting difference between the commanded and actual speeds is the speed error. The speed error is provided to a throttle control module 304 of controller 208. Throttle control module 304 generates a throttle command for prime mover 200 that will drive generator 204 to produce an output with a frequency that will cause motor 110 to operate at the speed indicated by the nominal speed command.

A first inner control loop 306 controls the excitation current applied to generator 204. Sensor 209 detects the rotational speed of the shaft (not shown) of prime mover 200. An excitation controller module 308 determines the excitation current that should be applied to generator 204. The excitation current is determined through use of a formula or a look-up table and is based at least in part on the detected speed of prime mover 200. The excitation controller module 308 generates a nominal excitation command that will cause generator exciter 206 to provide the determined excitation current.

A second inner control loop 310 interacts with first inner control loop 306 to optimize the operation of system 100 to limit the power expended in the operation. In the exemplary embodiment, second inner control loop 310 is not activated until outer control loop 301 has brought system 100 to its desired operating point. In some embodiments, second inner control loop 310 is inactive until system 100 remains at about the desired operating point for a period of time. The period of time may be a fixed (e.g., a preset or predetermined) period of time or variable (e.g., a period of time determined/calculated as a function of another variable). In the exemplary embodiment, second inner control loop 310 is deactivated if system 100 deviates from the desired operating point by more than a threshold amount. The threshold amount may be a fixed threshold or a variable threshold. For example, the threshold may be, without limitation, an absolute speed difference of motor 110, a fixed percentage speed difference, or a speed difference (whether an absolute speed or a percentage) that varies depending on another variable (such as temperature, inlet pressure, or a length of time). When second inner control loop 310 is inactive, the nominal excitation command generated by first inner control loop 306 is utilized by generator exciter 206 unmodified by second inner control loop 310.

Second inner control loop 310 receives voltage, frequency, and current measurements from sensors 214. An energy optimization module 312 determines the amount of power being output by generator 204 and used by motor 110. Energy optimization module 312 determines whether the output power of generator 204 is at a minimum output power that will maintain the current operating conditions (e.g., current desired operating point, current speed of motor 110 and/or prime mover 200, and/or current inlet pressure). Energy optimization module 312 determines an adjustment to be made to the nominal excitation command generated by excitation controller module 308. If the output power is substantially at a minimum, the adjustment will generally be zero (i.e., no adjustment is needed if output power is already at a minimum). Otherwise, a positive or negative adjustment to the nominal excitation command is determined. At 314, system controller 208 sums the nominal excitation command from excitation controller module 308 and the adjustment from energy optimization module 312 to produce the excitation command that is delivered to generator exciter 206.

In the exemplary embodiment, energy optimization module 312 utilizes a perturb and observe algorithm. An exemplary perturb and observe algorithm suitable for use in system 100 will be described below with reference to FIG. 4. In other embodiments, any other suitable energy optimization algorithm may be utilized. In some embodiments, the minimum output power and/or the adjustments may be determined from a look-up table based on one or more current operating condition.

Second inner loop 310 repeats periodically to attempt to minimize (and maintain the minimized) the power output by generator 204 while maintaining the desired operating point. In the exemplary embodiment, second inner loop 310 acts to produce an adjustment to the excitation command at a frequency that is slower than the frequency at which outer loop 301 is performed. Thus, for example, outer loop 301 may make several adjustments to the throttle command before inner loop 314 determines whether or not to change the adjustment to the nominal excitation command. In other embodiments, the frequency of inner loop 314 may be the same as or greater than the frequency of outer loop 301.

Figure 4:
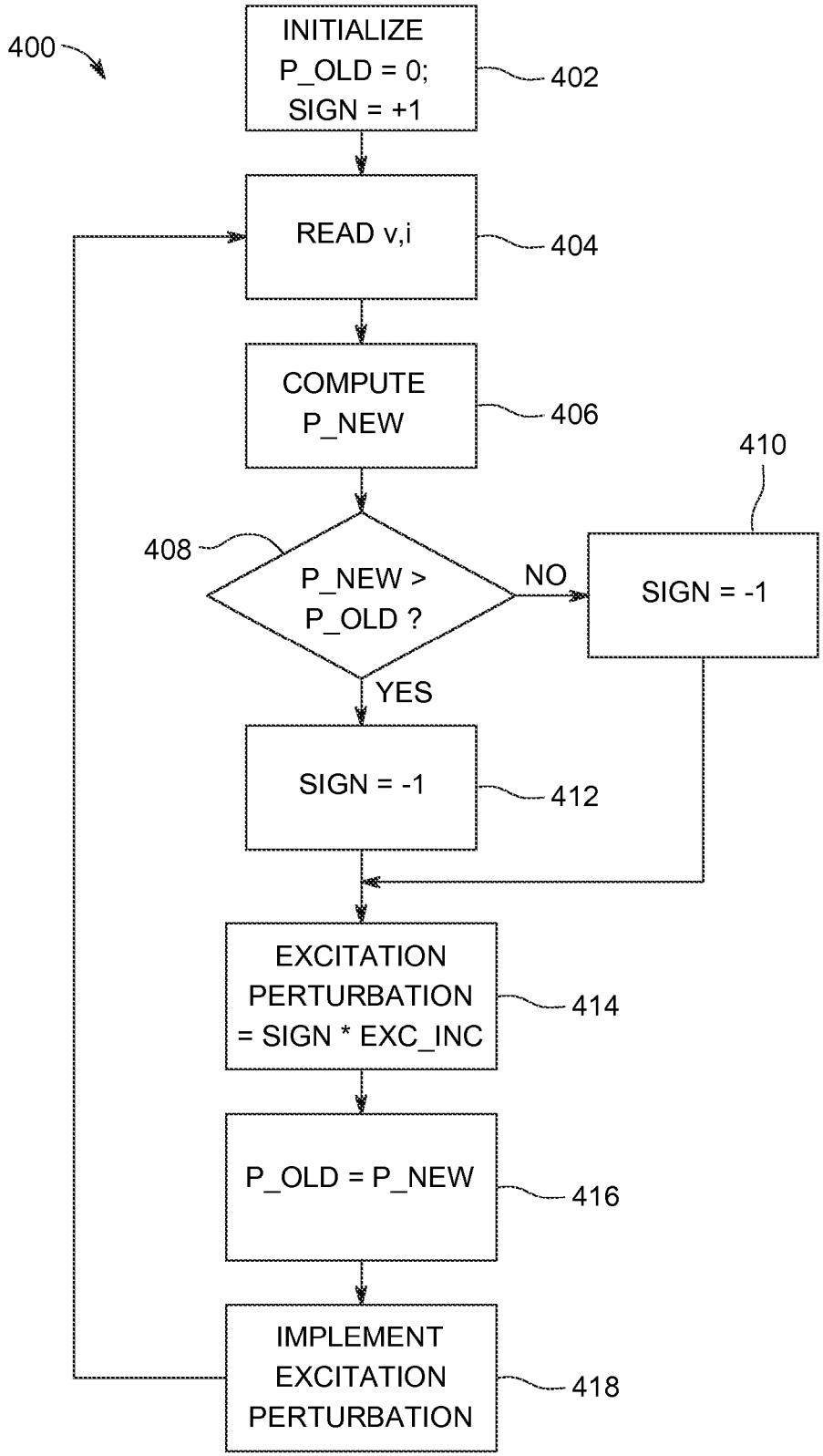
FIG. 4 is a flow diagram of an exemplary perturb and observe algorithm that may be used by the ESP system shown in FIG. 1.

FIG. 4 is a flow diagram of an exemplary perturb and observe algorithm 400 that may be used by system 100, and more particularly by system controller 208. At 402, controller 208 sets an initial value for an old power variable (P_old) equal to zero, and sets a variable Sign equal to +1. At 404, controller 208 reads the generator 204 output voltage and current values (v and i, respectively) detected by sensor 214. Controller 208 computes the current output power (P_new) from the values of the output voltage and current at 406. Controller determines, at 408, if the current output power value P_new is greater than the old output power value P_old. If the current output power P_new is greater than the old output power value P_old, the variable Sign is set equal to −1 at 410. If the current output power P_new is less than or equal to the old output power value P_old, the variable Sign is set equal to +1 at 412.

At 414, the excitation adjustment (also referred to as the excitation perturbation) is calculated by multiplying the variable Sign by an excitation increment (EXC_INC). The excitation increment determines how much the nominal excitation command will be adjusted each time second inner loop 310 perturbs the excitation current, and the value of the variable Sign determines in which direction (increasing or decreasing) the excitation current is perturbed. In the exemplary embodiment, the excitation increment is a predetermined, fixed value. In other embodiments, the excitation increment is a variable value and/or may be a calculated value. For example, the excitation increment may be increased or decreased as a function of how much the output power has changed after the last perturbation (i.e., based on the difference between P_new and P_old). The excitation increment may be increased to induce larger changes in the output power to move more quickly toward a minimum output power and decreased when near the minimum power point to limit overshooting the minimum. In some embodiments, the excitation increment value is periodically increased significantly for a single cycle. This will move the system off its previous operating point by a significant amount to combat the possibility that the perturb and observe algorithm has settled into an operating point that is a local minimum instead of the global minimum.

Controller 208 stores the current output power value P_new as the old output power variable P_old at 416. At 418, controller 208 implements the perturbation of the excitation current (e.g., by summing the nominal excitation current with the excitation perturbation calculated at 414). Algorithm 400 then returns to 404 to read the new voltage and current values. In some embodiments, algorithm 400 includes a delay, such as before returning from 418 to 404, to permit the perturbation to affect the output power and to limit introduction of instability into system 100. The time delay may be fixed or variable. A variable time delay may increase the time delay, for example, if controller 208 determines that the output power is relatively stable at the minimum power output. Thus, if the difference between P_new and P_old is small, or remains small for a certain number of cycles, controller 208 may increase the delay to avoid unnecessarily perturbing the excitation current for little or no efficiency gains. Conversely, if the difference between P_new and P_old is large, or remains large for a certain number of cycles, controller 208 may decrease the delay.

A converterless ESP system, such as system 100, eliminates the variable speed drive and, potentially, its associated transformer from a motor driven submersible pump system, resulting in a simpler system that reduces capital expense, weight and system footprint. The use of power generated on-site advantageously reduces the time it takes to put a well into production resulting from delays in getting the utility to install requisite power lines. Further, the use of natural gas produced by the well itself advantageously reduces the operating expense.

Because the output of the system generator is substantially sinusoidal when compared with the output of a variable speed drive, a filter is not required between the generator and the pump motor. Moreover, the converterless systems do not generate harmonics that are not filtered and that may lead to accelerated aging of the insulation systems in the transformer, cable, and pump motor of submersible pump systems including converters.

Furthermore, the control systems described herein operate converterless ESP systems at their desired operating points and refine that control to attempt to minimize the power produced and expended, while still remaining at the desired operating point. Thus, the exemplary systems and controllers increase the efficiency of ESP systems and allow them to be operated at reduced costs and/or greater profitability.

An exemplary technical effect of the methods, systems, and apparatus described herein includes at least one of: (a) eliminating power converters in an ESP systems by controlling the speed of the prime mover and the excitation current of the synchronous generator driven by the prime mover to maintain a desired pump inlet pressure; (b) reducing the temperature of components of an ESP system; (c) reducing the size of ESP systems; (d) extending the useful life of the components of an ESP system; and (e) increasing the efficiency of an ESP system.

Exemplary embodiments of the systems and methods are described above in detail. The systems and methods are not limited to the specific embodiments described herein, but rather, components of the systems and/or steps of the methods may be utilized independently and separately from other components and/or steps described herein. For example, the system may also be used in combination with other apparatus, systems, and methods, and is not limited to practice with only the system as described herein. Rather, the exemplary embodiment can be implemented and utilized in connection with many other applications. Although specific features of various embodiments of the disclosure may be shown in some drawings and not in others, this is for convenience only. In accordance with the principles of the disclosure, any feature of a drawing may be referenced and/or claimed in combination with any feature of any other drawing.

Some embodiments involve the use of one or more electronic or computing devices. Such devices typically include a processor or controller, such as a general purpose central processing unit (CPU), a graphics processing unit (GPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer readable medium, including, without limitation, a storage device and/or a memory device. Such instructions, when executed by a processor, cause the processor to perform at least a portion of the methods described herein. The above examples are exemplary only, and thus are not intended to limit in any way the definition and/or meaning of the term processor.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A converterless motor-driven pump system comprising:

an off-grid prime mover;

an electric power generator driven by said off-grid prime mover to generate power output;

an electric submersible pump (ESP) system comprising a motor coupled to said electric power generator to receive the power output from said electric power generator;

a pump driven by said motor to pump a fluid, said pump including an inlet; and a system controller comprising a processor and a memory, said memory including instructions that, when executed by said processor, cause said system controller to:

control a rotational speed of said off-grid prime mover as a function of an operational parameter of said ESP system to maintain a desired operating point of said pump; and control said electric power generator to reduce the power output generated by said electric power generator while the desired operating point of said pump is maintained, wherein said electric power generator comprises a synchronous generator and said power output is an alternating current (AC) power output, wherein said memory includes instructions that, when executed by said processor, cause said system controller to control said electric power generator to reduce the AC power output generated by said electric power generator by controlling an excitation current applied to said synchronous generator, wherein said memory further includes instructions that, when executed by said processor, cause said system controller to perturb the excitation current applied to said synchronous generator and observe the effect of the perturbed excitation current on the AC power generated by said electric power generator.

2. The converterless motor-driven pump system according to claim 1, wherein said memory includes instructions that, when executed by said processor, cause said system controller to determine a nominal excitation current to be applied to said synchronous generator as a function of a speed of said off-grid prime mover to maintain the desired operating point of said pump.

3. The converterless motor-driven pump system according to claim 2, wherein said memory includes instructions that, when executed by said processor, cause said system controller to determine an adjustment to the nominal excitation current and apply the adjustment to the nominal excitation current to produce an excitation command.

4. The converterless motor-driven pump system according to claim 3, wherein said memory includes instructions that, when executed by said processor, cause said system controller to compare a current AC power output to an earlier AC power output generated by said electric power generator, determine the adjustment to reduce the nominal excitation current if the current AC power output is greater than the earlier AC power output, and determine the adjustment to increase the nominal excitation current if the current AC power output is less than the earlier AC power output.

5. The converterless motor-driven pump system according to claim 3, further comprising a generator exciter configured to provide excitation current to said synchronous generator in response to the excitation command.

6. The converterless motor-driven pump system according to claim 1, wherein said memory includes instructions that, when executed by said processor, cause said system controller to control said electric power generator to reduce the AC power output by controlling an output voltage of said electric power generator.

7. A method of operating a converterless motor-driven pump system including an off-grid prime mover driving an electric power generator to produce a power output for an electric submersible pump (ESP) system including motor driving a submersible pump, said method comprising:

controlling a rotational speed of the off-grid prime mover as a function of an operational parameter of the ESP system to maintain a desired operating point of the submersible pump;

controlling a voltage output of the electric power generator to reduce the power output generated by the electric power generator while maintaining the desired operating point of the submersible pump, wherein the electric power generator comprises a synchronous generator, the power output is an alternating current (AC) power output, and controlling the voltage output of the electric power generator to reduce the AC power output generated by the electric power generator comprises controlling an excitation current applied to the synchronous generator, wherein controlling the voltage output of the electric power generator to reduce the AC power output generated by the electric power generator comprises determining an adjustment to the determined nominal excitation current, wherein determining the adjustment to the determined nominal excitation current comprises determining the adjustment to the determined nominal excitation current using a perturb and observe algorithm; and determining a nominal excitation current to be applied to the synchronous generator as a function of the speed of the off-grid prime mover to maintain the desired operating point of the pump.

8. A system controller for a converterless motor-driven pump system including a prime mover, an electric power generator driven by the prime mover to generate a power output, and an electric submersible pump (ESP) system including a motor powered by the power output and a pump driven by the motor, said system controller comprising a processor and a memory, said memory including instructions that, when executed by said processor, cause said system controller to:

control a rotational speed of the prime mover as a function of an operational parameter of the ESP system to maintain a desired operating point of the pump; and control the electric power generator to reduce the power output generated by the electric power generator while the desired operating point of the pump is maintained wherein the electric power generator includes a synchronous generator, the power output is an alternating current (AC) power output, and said memory includes instructions that, when executed by said processor, cause said system controller to control the electric power generator to reduce the AC power output generated by the electric power generator by controlling an excitation current applied to the synchronous generator, wherein said memory further includes instructions that, when executed by said processor, cause said system controller to perturb the excitation current applied to the synchronous generator and observe the effect of the perturbed excitation current on the AC power generated by the electric power generator, wherein a direction in which the excitation current is perturbed is based, at least in part, on an observed effect of a previous perturbation of the excitation current.

9. The system controller according to claim 8, wherein said memory includes instructions that, when executed by said processor, cause said system controller to determine a nominal excitation current to be applied to the synchronous generator as a function of a speed of the prime mover to maintain the desired operating point of the pump.

10. The system controller according to claim 9, wherein said memory includes instructions that, when executed by said processor, cause said system controller to determine an adjustment to the nominal excitation current and apply the adjustment to the nominal excitation current to produce an excitation command.

11. The system controller according to claim 10, wherein said memory includes instructions that, when executed by said processor, cause said system controller to compare a current AC power output to an earlier AC power output generated by said electric power generator, determine the adjustment to reduce the nominal excitation current if the current AC power output is greater than the earlier AC power output, and determine the adjustment to increase the nominal excitation current if the current AC power output is less than the earlier AC power output.

* * * * *